US006820938B2

(12) United States Patent
Barrett

(10) Patent No.: US 6,820,938 B2
(45) Date of Patent: Nov. 23, 2004

(54) TAIL BONE CUSHION

(75) Inventor: W. Raymond Barrett, St. Louis, MO (US)

(73) Assignee: Biomedical Systems Corporation, St. Louis, MO (US)

( * ) Notice: Subject to any disclaimer, the term of this patent is extended or adjusted under 35 U.S.C. 154(b) by 0 days.

(21) Appl. No.: 10/385,103

(22) Filed: Mar. 10, 2003

(65) Prior Publication Data

US 2004/0195898 A1 Oct. 7, 2004

(51) Int. Cl.[7] ..... A47C 7/02
(52) U.S. Cl. ..... 297/452.41; 297/4
(58) Field of Search ..... 297/452.41, 4, 297/DIG. 3, DIG. 6, 219.1, 228.12; 5/654, 655.3

(56) References Cited

U.S. PATENT DOCUMENTS

| | | | | | |
|---|---|---|---|---|---|
| D33,543 | S | | 11/1900 | Hogan et al. | |
| D33,613 | S | | 11/1900 | Hogan et al. | |
| D33,763 | S | | 12/1900 | Meinecke et al. | |
| 726,164 | A | | 4/1903 | Hogan et al. | |
| 804,750 | A | | 11/1905 | Meinecke et al. | |
| 1,218,291 | A | | 3/1917 | Meinecke | |
| 1,230,690 | A | | 6/1917 | Eggers | |
| 1,468,072 | A | * | 9/1923 | Ogle | 128/889 |
| 2,582,439 | A | * | 1/1952 | Kavangh | 297/396 |
| 3,331,087 | A | | 7/1967 | Barlow | |
| 4,024,861 | A | | 5/1977 | Vincent | |
| 4,207,633 | A | * | 6/1980 | Smith et al. | 5/632 |
| D255,966 | S | | 7/1980 | Stadel | |
| 4,255,824 | A | | 3/1981 | Pertchik | |
| 4,777,679 | A | | 10/1988 | DeLooper | |
| 4,867,140 | A | | 9/1989 | Hovis et al. | |
| 4,905,332 | A | | 3/1990 | Wang | |
| 4,923,247 | A | * | 5/1990 | Malmstrom | 297/4 |
| 4,998,301 | A | * | 3/1991 | Markus | 4/457 |
| 5,070,559 | A | * | 12/1991 | Pettifer | 5/659 |
| 5,085,214 | A | | 2/1992 | Barrett | |
| 5,275,315 | A | * | 1/1994 | Carmack et al. | 224/576 |
| 5,303,977 | A | * | 4/1994 | Sereboff | 297/230.1 |
| 5,461,741 | A | * | 10/1995 | Graebe | 5/654 |
| 5,487,197 | A | * | 1/1996 | Iskra, Jr. et al. | 5/654 |
| 5,634,685 | A | * | 6/1997 | Herring | 297/219.11 |
| 5,702,153 | A | | 12/1997 | Pliska | |
| 5,785,669 | A | | 7/1998 | Proctor et al. | |
| 5,970,545 | A | | 10/1999 | Garman et al. | |
| 6,209,159 | B1 | * | 4/2001 | Murphy | 5/654 |
| 6,354,665 | B1 | * | 3/2002 | Ross | 297/452.41 |
| 6,413,194 | B1 | * | 7/2002 | Gant | 482/112 |

* cited by examiner

*Primary Examiner*—Milton Nelson, Jr.
(74) *Attorney, Agent, or Firm*—Senniger Powers

(57) ABSTRACT

An inflatable bladder supports the body of a person and relieves pressure on a portion of the body not engaging the bladder. The bladder has at least one rear chamber adapted to receive and maintain a first charge of fluid. At least one front chamber supports the legs of the person and has two support legs. The support legs are spaced apart from each other to form a channel between the support legs. The channel is sized and shaped for placement beneath a portion of the body to relieve pressure on the portion. The front chamber is adapted to receive and maintain a second charge of fluid separately from the rear chamber.

25 Claims, 5 Drawing Sheets

TAIL BONE CUSHION

BACKGROUND OF INVENTION

The invention relates generally to a medical cushion and more particularly to an inflatable U-shaped cushion to support a patient's legs and abdomen to eliminate pressure on the patient's tail bone and to provide for ventilation (i.e., fresh air flow) to the tail bone.

Bed sores, ulcers, or blisters commonly exist near the tail bone of patients who are temporarily disabled and confined to a wheel chair or a hospital bed for long periods of time. Frequently, patients who are disabled or injured require medication to be applied to such injuries. Commonly, when medication is applied to a patient's bedsores, ulcers, or blisters ventilation (i.e., fresh air flow) of the injured area is desirable to facilitate healing of the damaged tissue. When a patient is disabled, the posterior region lies against the bed or chair seat for long periods of time so that ventilation is inhibited. To facilitate healing of the sores a method of supporting a patient's body is required so that the tail bone region is exposed to fresh air to adequately ventilate the injured area.

To reduce pain and suffering of the patient, a method of supporting a patient's body must distribute pressure around and away from the patient's injured area so that a patient's weight is distributed over more than a few points of contact of the cushion with the body. The existence of a single concentrated pressure point causes pain and irritation around an injured area because of the concentration of force on a small surface area of the body. The presence of singular or minimal pressure points can lead to break downs of skin tissue that inhibits a patient's recovery by increasing the likelihood of additional bed sores and the potential for infection.

As a result of inadequate support to the patient's body surrounding the ulcer, existing cushions do not fully relieve pressure from the patient's tail bone to facilitate healing and have not been designed to provide for ventilation (i.e., fresh air flow) to the tail bone. Existing cushions do not adequately alleviate the occurrence of pressure points to a patient's body surrounding a sensitive injured area. Also, existing cushions do not provide multiple chambers that allow a patient to selectively adjust the air pressure to eliminate concentrated pressure points or to distribute pressure to different areas of the cushion. The selective adjustment of air pressure in different areas of the cushion allows a patient to adjust the firmness or softness of a specific section of the cushion to correspond to the desired firmness or softness of the corresponding area of the patient's body. The selective adjustment of air pressure in different regions facilitates healing of an injured area by preventing the creation of various pressure points on the sensitive areas of the body surrounding an injured area.

A further problem inherent in existing designs is the attachment mechanism for attaching the cushion to the patient. It is imperative that the cushion be securely attached to the patient's body in order to prevent the cushion from moving and causing further irritation of the inflamed area. Various existing cushions are designed to fit in a patient's trousers, but these cushions lack a mechanism to prevent the cushion from moving in relation to the patient's body. The geometric shapes of other cushions prevent comfortable use by patients who are not ambulatory.

SUMMARY OF THE INVENTION

Among the several objects and features of the present invention may be noted the provision of an inflatable bladder which fully relieves pressure from a patient's tail bone area; the provision of such an inflatable bladder which provides an improved pressure distribution over the area of the bladder in contact with the patient; the provision of such an inflatable bladder which provides adequate ventilation (i.e., fresh air flow) to facilitate healing; the provision of such an inflatable bladder that is secured to a patient to prevent movement of the bladder in relation to the patient, and the provision of such inflatable bladder which allows selective variance of air pressure throughout the bladder.

Generally, the inflatable bladder of the present invention comprises at least one rear chamber to receive and maintain a first charge of fluid within the rear chamber. At least one front chamber for supporting the legs of the person has two support legs spaced apart from each other to form a channel between the support legs. The channel is sized and shaped for placement beneath a portion of the person's body to relieve pressure on that portion. The front chamber is adapted to receive and maintain a second charge of fluid within the front chamber.

In another aspect of the present invention, the inflatable bladder of the present invention generally comprises at least one chamber adapted to receive and maintain a charge of fluid. The chamber is sized and shaped to form a channel for placement beneath a portion of the body to relieve pressure on the portion. A padded cushion is adapted for attachment to the bladder for placement between the bladder and the person to provide further cushioning to the person. At least one strap is attachable to the cushion for attaching the bladder to the person.

In yet another aspect of the present invention, a method for elevating and supporting the coccyx of a patient to relieve pressure and reduce pain and irritation is provided. The method generally comprises placing an inflatable bladder underneath the patient. The bladder is attached to the patient by wrapping straps attachable to the bladder around the patient and securing the straps and bladder to the patient. The air pressure within the bladder is selectively adjusted to support the patient without placing undue pressure upon a particular portion of the patient's body. Other objects and features of the present invention will be in part apparent and in part pointed out hereinafter.

BRIEF DESCRIPTION OF DRAWINGS

Corresponding reference characters indicate corresponding parts throughout the several views of the drawings.

DETAILED DESCRIPTION OF THE ILLUSTRATED EMBODIMENT

Figure 1:
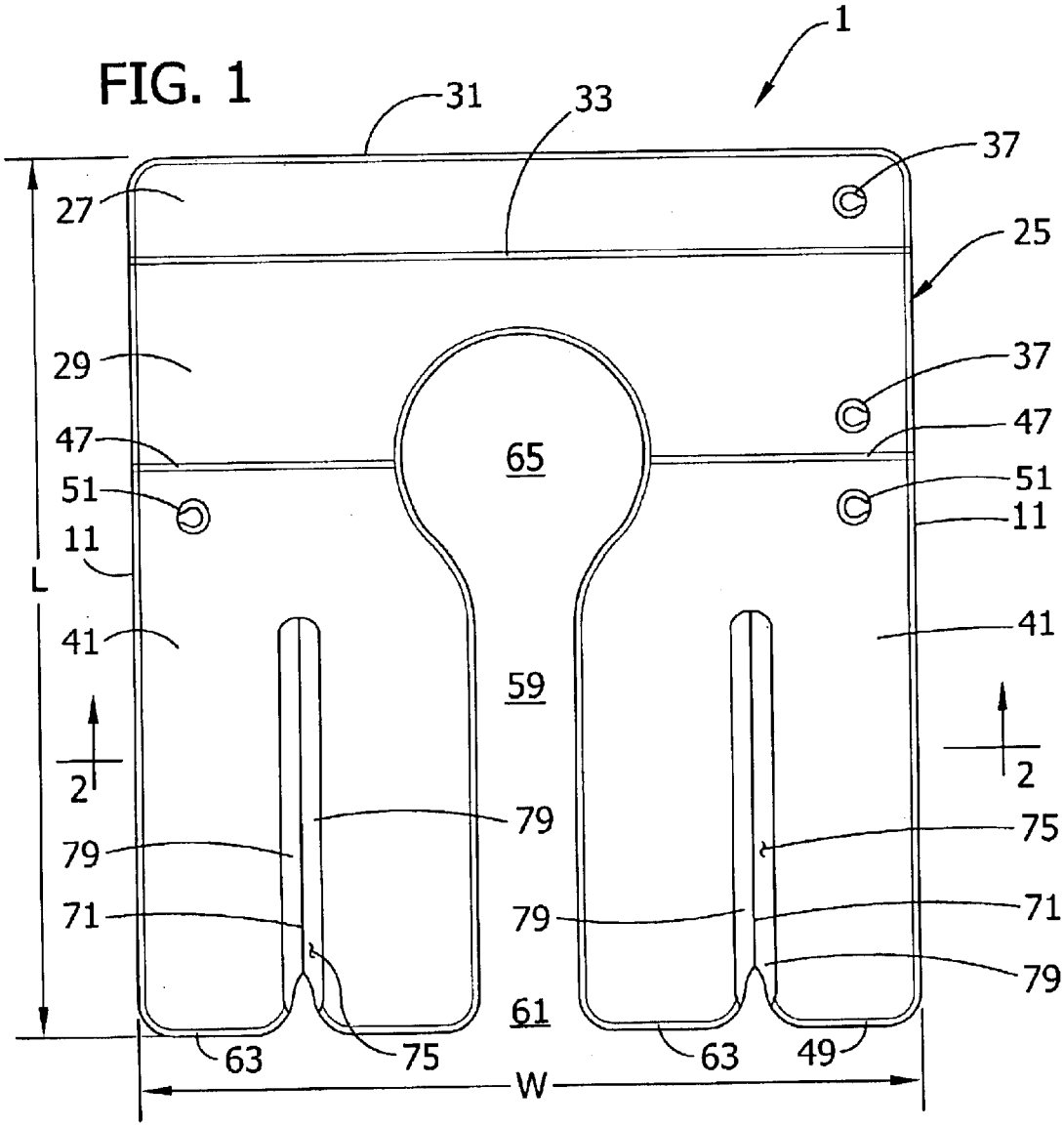
FIG. 1 is a top plan view of an inflatable bladder of the present invention.
Figure 2:
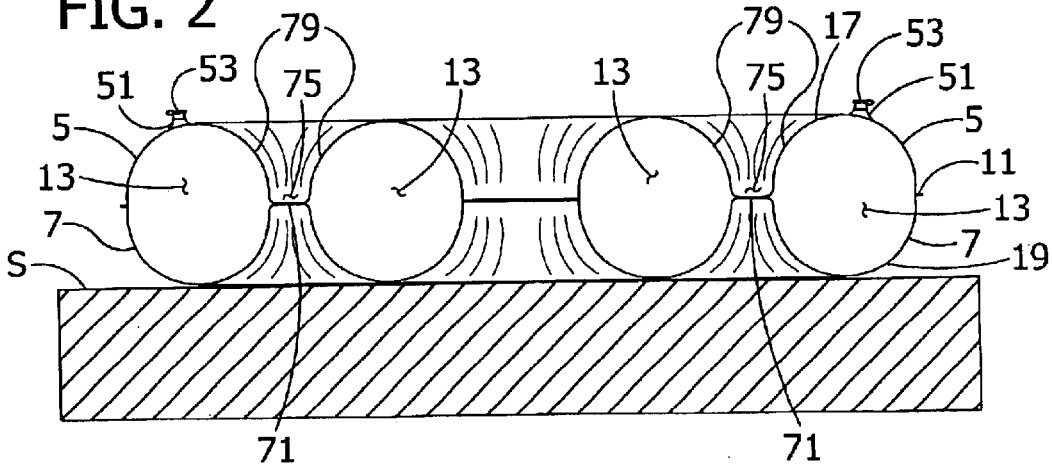
FIG. 2 is a cross-section of the inflatable bladder taken in the plane including line 2—2 of FIG. 1.

Referring now to the drawings and in particular to FIGS. 1 and 2, an inflatable bladder of the present invention is generally indicated at 1. The bladder is used to support the body of a person (not shown) such as a bedridden medical patient and to relieve pressure on an injured area of the patient's body. In the illustrated embodiment, the inflatable bladder 1 comprises an upper sheet 5 and a lower sheet 7 joined at their end margins along a common outer seam 11 to define an interior 13 of the bladder 1. As will be described below in more detail, the interior 13 of the bladder 1 is adapted to receive and maintain a charge of fluid (e.g., air) for supporting the body of the patient. The upper sheet 5 and the lower sheet 7 are made of a suitable air impermeable material (e.g., vinyl, rubber). The outer surface 17 of the upper sheet 5 contacts a wearer of the bladder 1. In a typical case, the wearer is a non-ambulatory medical patient and more specifically patients having ulcers on their tail bones. The outer surface 19 of the lower sheet 7 contacts a surface S, typically a bed or a wheelchair, that supports the patient.

In the illustrated embodiment of FIGS. 1–5, the bladder 1 includes a rear chamber, generally designated 25, that is comprised of a first rear subchamber 27 and second rear subchamber 29. In the embodiment of FIGS. 1–5, the first rear subchamber 27 is located at the first end 31 of the inflatable bladder 1. Second rear subchamber 29 is adjacent to the first rear subchamber 27 with a common seam 33 therebetween. Each rear subchamber 27 and 29 is adapted to maintain a separate charge of fluid that is received through a respective rear subchamber valve 37. Two support legs 41 (broadly "front chambers" or "front subchambers") extend from a common seam 47 shared with the second rear subchamber 29 to end margins that define a second end 49 of the bladder 1. The first and second support legs 41 are capable of receiving separate charges of fluid through respective first and second support leg valves 51. In the illustrated embodiment, the rear subchamber valves 37 and support leg valves 51 are push-pull type valves having an integral cap 53 and internal check valve (not shown). It will be understood that other types of valves could be connected to the bladder 1 (e.g., elbow connector valve with integral check valve) or the valves 37, 51 could be manufactured as an integral part of the bladder. In the illustrated embodiment, the valves 37, 51 are shown in the extended position, however, it will be understood that these valves could be pushed into the bladder 1 so that the cap 53 is flush with the outer surface 17 of the upper sheet 5.

The first and second support legs 41 are spaced laterally to define a channel 59 between them. In the embodiment shown in FIG. 1, the channel 59 includes an open end 61 opening outwardly of the inflatable bladder 1 at the free end 63 of the support legs 41. An inner end portion 65 of the bladder 1 is located at the end of the channel opposite the open end 61 and is partially defined by the second rear subchamber 29 and the first and second support legs 41. Typically, the channel 59 and the inner end portion 65 can be sized and shaped to relieve pressure and allow air circulation to a patient's coccyx. However, it will be understood that the bladder 1 can be sized and shaped to relieve pressure from other parts of a patient's body. In the illustrated embodiment, the inner end portion 65 has a larger width than the channel 59 and has a roughly circular shape, as depicted in FIG. 11 or alternatively may have other shapes such as polygonal. As discussed below in more detail, the bladder 1 is inserted between a patient's body (not shown) and a surface S (e.g., a bed) to support a patient's body. The bladder 1 contacts a patient's body at points away from the sensitive injured area (e.g., the coccyx) so that the weight of the person is supported away from the injured area. Because the bladder 1 is sized and shaped so that the patient's injured area is situated above the inner end portion 65, the injured area is elevated above the surface S allowing air to circulate to the injured area via the channel.

The upper sheet 5 and lower sheet 7 are connected together along the common outer seam 11, the seam 33 between first and second rear subchambers 27, 29 and the seam 47 between the second rear subchamber 29 and the first and second support legs 41. Additionally, the upper and lower sheets 5, 7 are joined along seams 71 located inward from the peripheral edges of the sheets and extending longitudinally of each support leg 41. The seams 71 form furrows 75 centered laterally on each support leg 41. The furrows 75 are sized and shaped to receive a portion of a patient's leg (not shown) to maintain the relative position of the leg of the patient and the support leg 41 of the inflatable bladder 1. When a patient's legs are centered on the respective first and second support leg furrows 75, each leg will be supported by the upward sloping surfaces 79 of the top sheet 5 of the bladder 1. By receiving portions of respective legs, each furrow 75 resists relative sliding movement between the legs and bladder 1 which helps maintain a patient's legs in the centered position on the support legs 41 of the bladder.

The specific dimension of the inflatable bladder 1 will vary, depending on the relative size of the patient as well as the specific area of the body that is injured. However, a bladder of one size can service many patients. By way of example, the bladder 1 may have an overall width W of about 19½ inches and an overall length L of about 23 inches. Each support leg 41 may have a corresponding width of about 8½ inches with each furrow 75 having a longitudinal length of about 11 inches. The open space defined by the bladder 1 including the inner end portion 65 may have an overall length of about 18 inches with the inner end portion having a diameter of about 6 inches.

Figure 3:
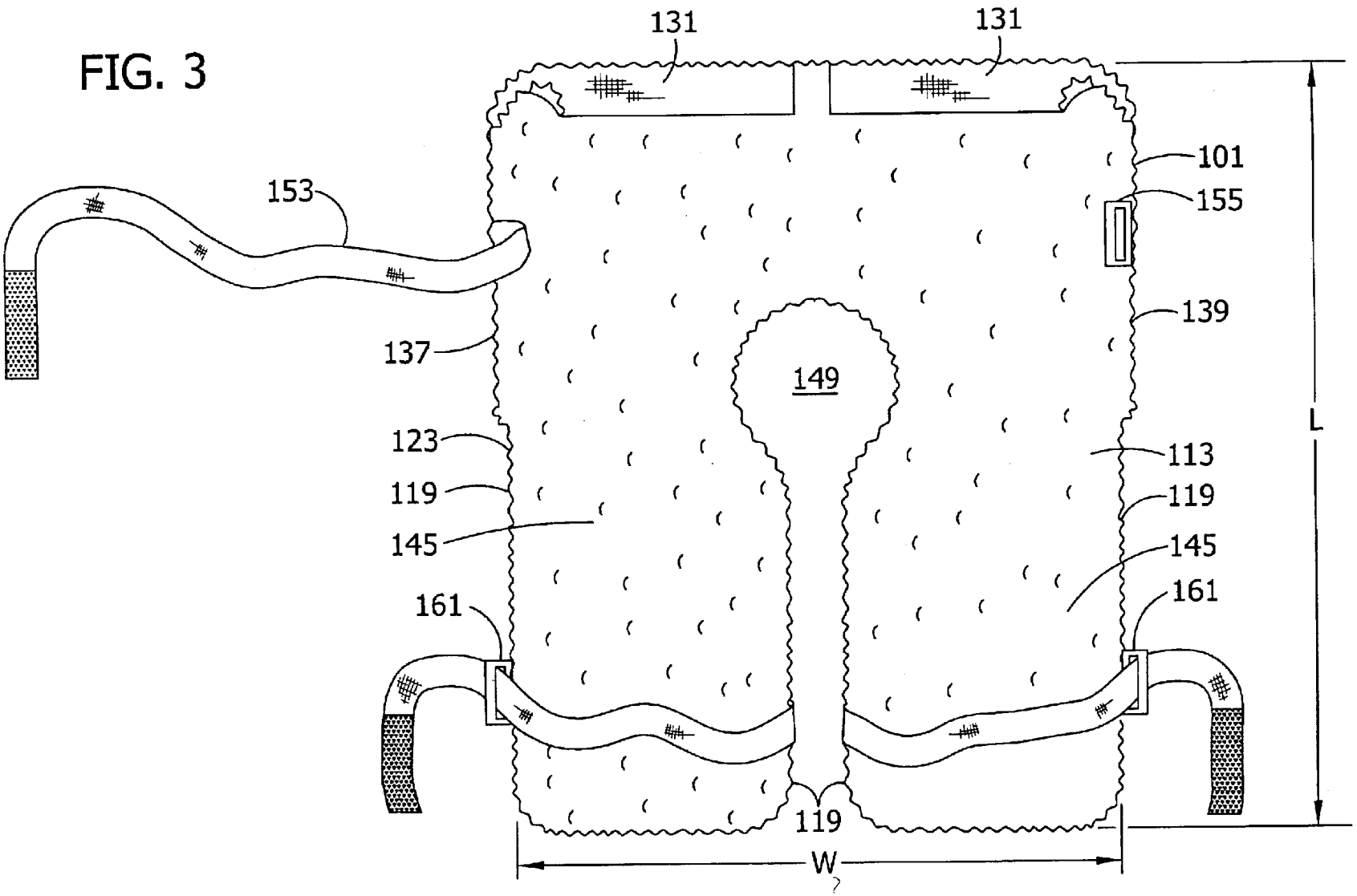
FIG. 3 is a top plan view of the inflatable bladder received in a padded sleeve.
Figure 4:
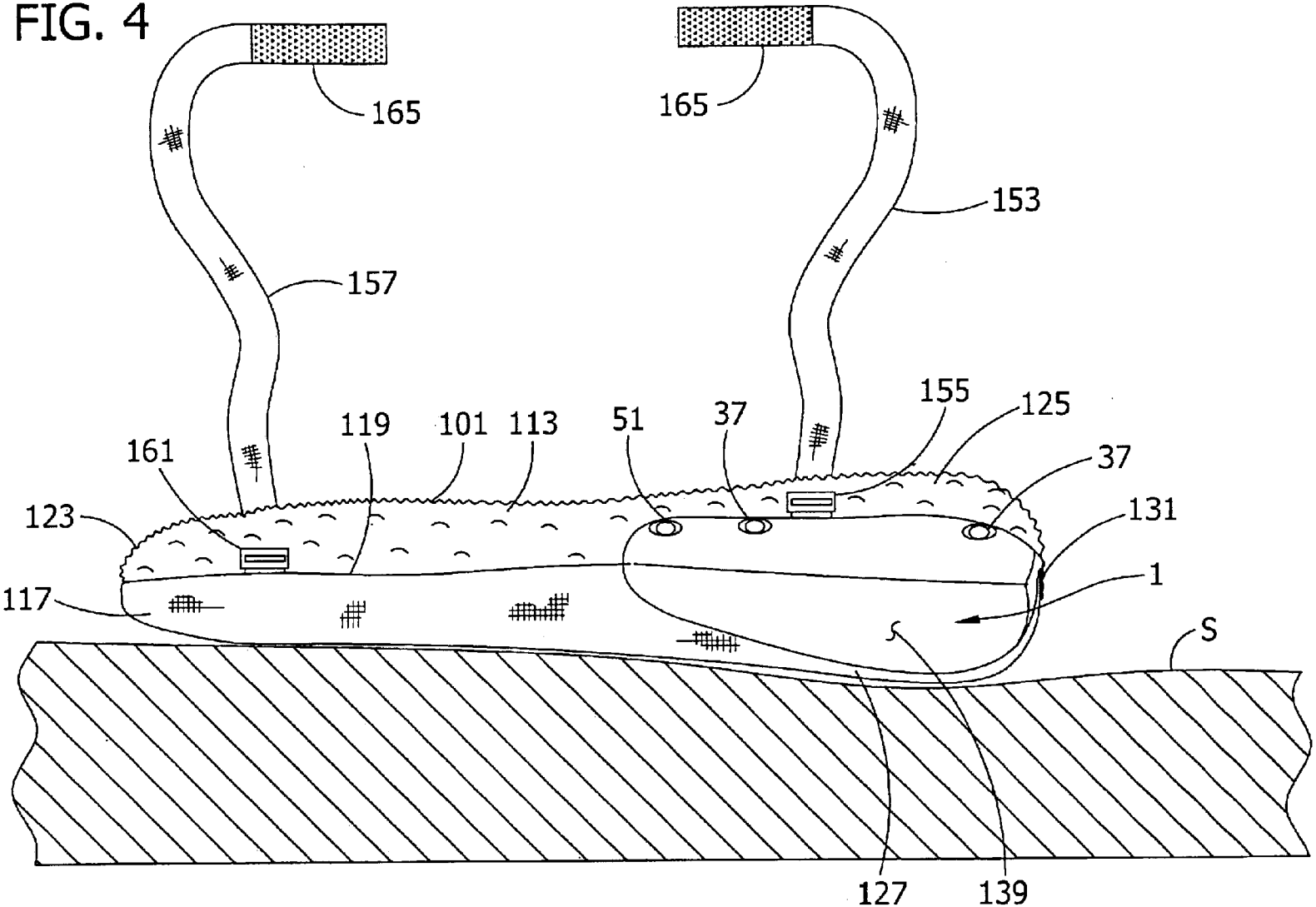
FIG. 4 is a right side elevation of the bladder and sleeve of FIG. 3.
Figure 5:
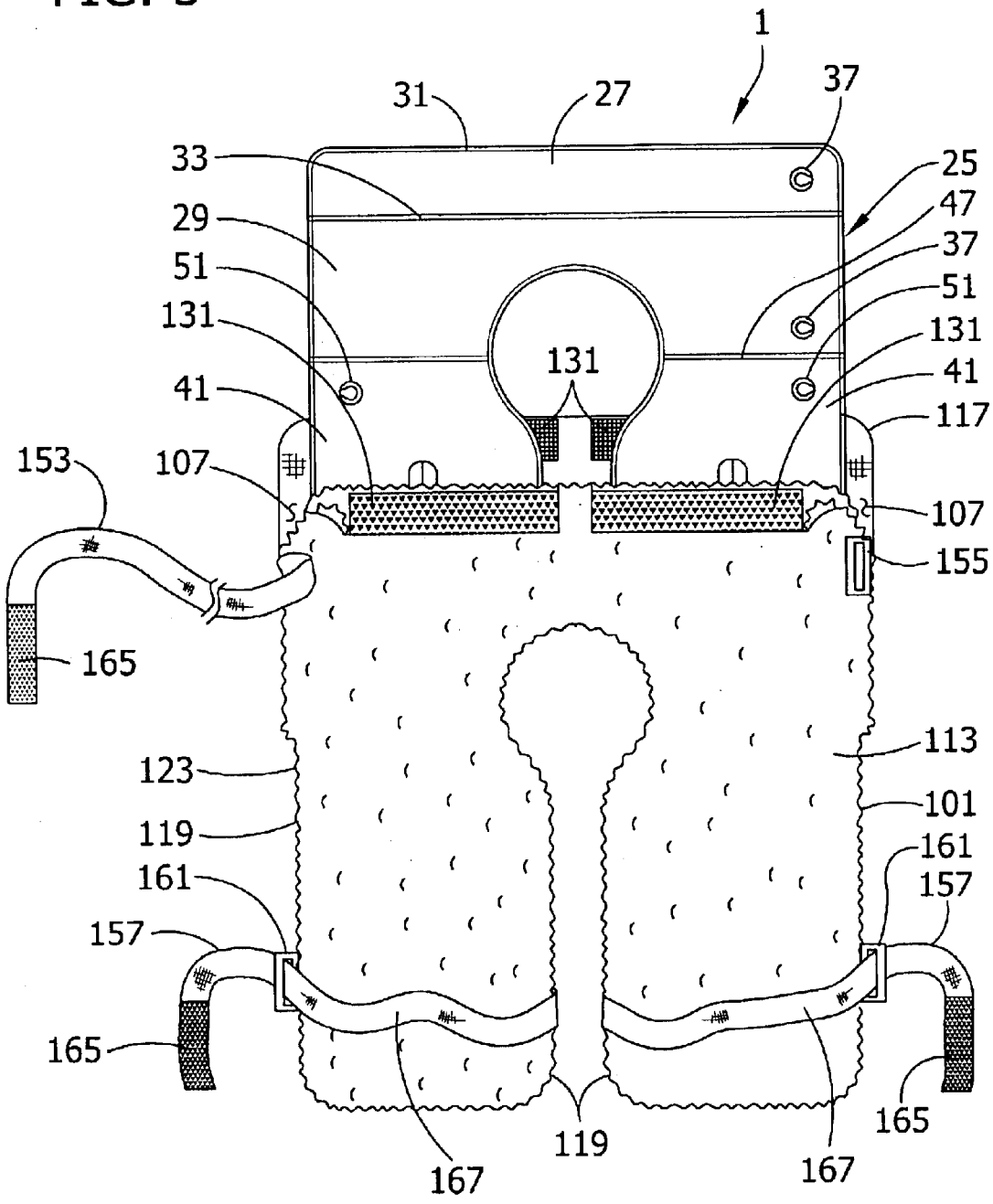
FIG. 5 is a top plan view of the inflatable bladder partially removed from the cushion and sleeve.

FIGS. 3–5 depict the inflatable bladder 1 of the present invention attached to a padded cushion 101 generally made of a softer material than the bladder to provide cushioning to a patient and more readily allow air to contact the patient's skin. The padded cushion 101 has a hollow interior sized and shaped for receiving the inflatable bladder 1 of to FIGS. 1 and 2. An opening 107 extends into the hollow interior and is sized and shaped to allow the inflatable bladder 1 to be inserted and withdrawn from the padded cushion 101. The top side of the padded cushion 101 comprises a soft pad 113 and the bottom side of the cushion comprises a backing 117. It will be understood that the soft pad 113 could be manufactured from any typical material that provides a soft, comfortable, breathable surface for engaging the patient's body (e.g., shearling or synthetic lamb's wool) and the backing 117 may be manufactured from any typical flexible material that provides a slip resistant surface (e.g., nylon). The soft pad 113 and backing 117 are joined at a seam 119 at their respective edge portions to define a sleeve 123 for receiving the bladder 1. The soft pad 113 and backing 117 have flaps, 125 and 127 respectively, that are independently movable at the opening 107 in the cushion 101. As illustrated in FIGS. 3 and 4, a closure 131 is positioned on the outer surface of each flap 125, 127 for releasably holding the cushion 101 in the closed position. As shown in FIG. 4, the closure 131 permits the flaps to close the opening 107 of the cushion 101 and retain the inflatable bladder 1 within the cushion. In the illustrated embodiment, the closure 131 is a hook and loop type closure (e.g., a closure sold under the trademark VELCRO) but it will be understood that the closure may be other types well known in the art (e.g., resealable adhesive, resealable two sided tape, snaps, buttons, hooks, etc.). The two flaps 125, 127 together define opposite side openings 137, 139 in the cushion 101 to allow access the rear chamber valves 37 and the support leg valves 51 so that the air pressure in the inflatable bladder 1 can be adjusted after the bladder has been secured in the cushion. The cushion 101 includes two leg sections 145 that define an open space 149 generally corresponding to the channel 59 and the inner end portion 65 of the inflatable bladder 1.

In the illustrated embodiment, the cushion 101 has a hip strap 153 attached to the flap 125 of the soft pad 113 adjacent one of the side openings 137. A grommet 155 is attached at the edge of the flap 125 opposing the attachment point of the hip strap 153 to allow the hip strap to be threaded through the grommet and secured around the patient. The cushion 101 has two leg straps 157 attached at the leg portions 145 of the cushion at the seam 119 joining the soft pad 113 and the backing 117. A grommet 161 is attached to the seam 119 at a location opposing the attachment point of each leg strap 157 to allow the leg strap to be easily threaded through the grommet and secured to the patient. The hip strap 153 and two leg straps 157 are made of a flexible and stretchable cloth material (e.g., material sold under the trademark VELSTRETCH) that allows the straps to be easily threaded through the grommets 155, 161 and pulled tight against the patient's body. In the illustrated embodiment, the straps 153, 157 are made of a material that comprises the loop side of a common hook and loop type fasteners (e.g., fasteners sold under the trademark VELCRO). Each strap 153, 157 has a fastener strip 165 attached near the free end of each strap that comprises the hook side of a common hook and loop type fastener. The fastener strips 165 are attached to each strap 153, 157 via adhesives or other attachment means (e.g., sewing). In the illustrated embodiment the fastener strips 165 and the straps 153, 157 together form a hook and loop type fastener, although it will be understood that other suitable fasteners for securing the straps may be used (e.g., buckles, snaps or adhesives). To attach the cushion 101 to the patient, the hip straps 153 and leg straps 157 are placed over the portion of a patient's body above the pad 113 with the fastener strips 165 of the straps threaded through the corresponding grommet 155, 161. Each strap 153, 157 is pulled tight against the patient's body with the corresponding fastener strip 165 extending from the grommet 155, 161 and folded back for attachment to the portion 167 (FIG. 5) of the strap not threaded through the grommet. The secure attachment of the fastener strips 165 to the tightened hip strap 153 and leg straps 157 secures the cushion 101 and inflatable bladder 1 to the patient's body. The use of the hip strap 153 and two leg straps 157 allows the inflatable bladder 1 to be secured to the patient's body at three different locations to prohibit relative movement between the patient's body and the bladder.

The cushion 101 will be generally sized and shaped to be slightly larger than the inflatable bladder 1 so that a secure fit exists between the bladder and the cushion. By way of example, the cushion 101 may have an overall width W of about 21 inches and an overall length L of about 26 inches. Each leg section 145 of the cushion may have an overall width of about 9 inches. The open space 149 between adjacent leg sections 145 may have a length of about 18 inches.

Figure 6:
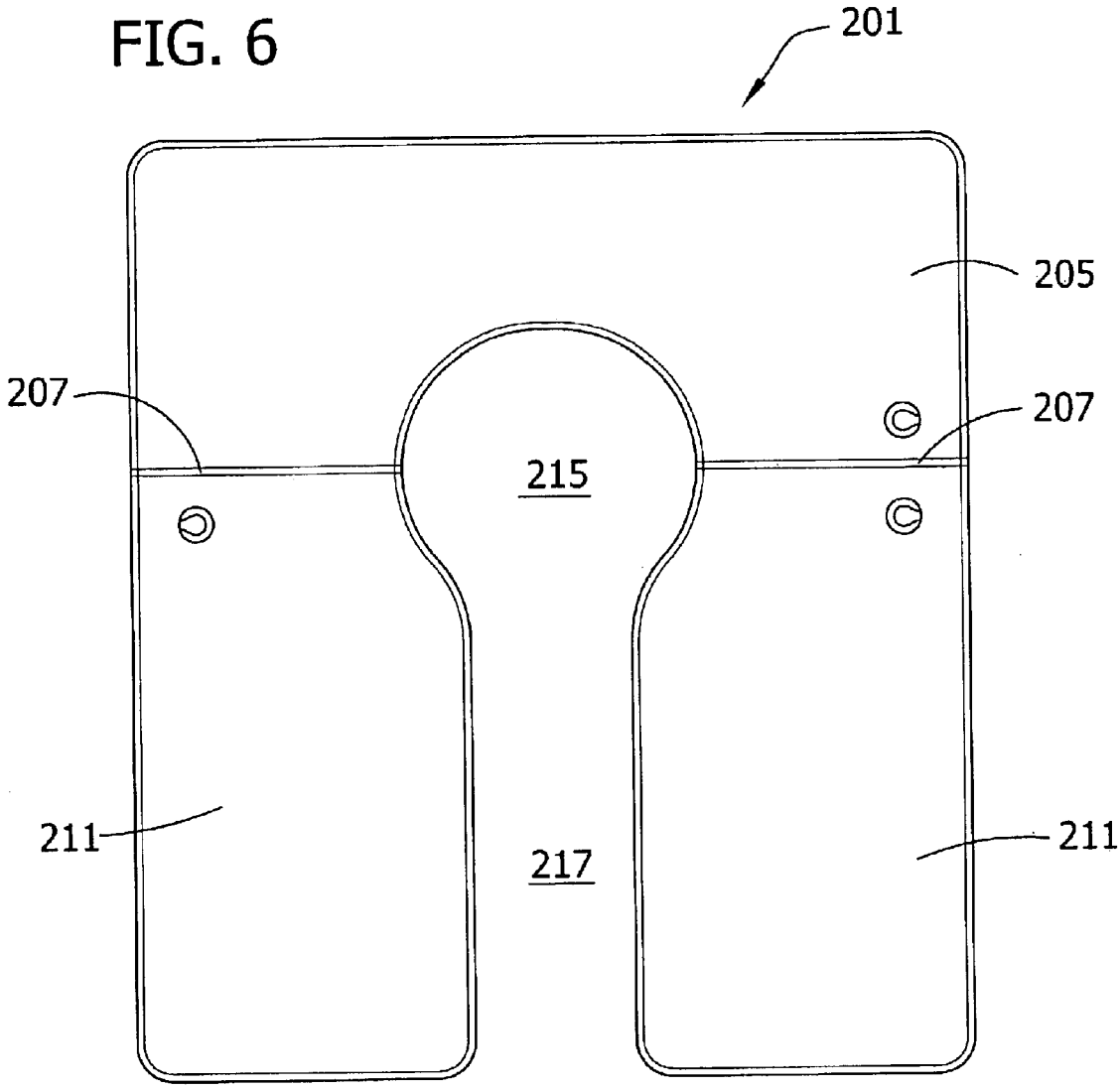
FIG. 6 is a top plan view of a second embodiment of the inflatable bladder.

A second embodiment of the inflatable bladder, generally designated 201, is shown in FIG. 6. This embodiment is substantially similar to the first embodiment 1 except that the bladder 201 has a single rear chamber 205 that shares a common seam 207 with separate support legs 211. An inner end portion 215 of the channel 217 in this embodiment is arranged so that the bladder 201 defines a larger open space than the previous embodiment. Also, the support legs 211 of this embodiment are provided without the furrows 75 of the previous embodiment. It will be understood that the padded cushion 101 of FIGS. 3–5 could be correspondingly sized and shaped to receive the inflatable bladder 201 of FIG. 6 as well as inflatable bladders of other sizes and configurations.

In use the inflatable bladder 1 is placed between the body of a patient and a surface S to relieve pressure and reduce pain and irritation to an area of a patient's body (e.g., coccyx or tail bone). It will be understood that the bladder 1 may be used alone or in combination with the padded cushion 101. Typically, the bladder 1 is at least partially inflated before first being inserted into the opening 107 in the cushion 101. After the bladder 1 is inserted into the cushion 101, the closure 131 on the flaps 125, 127 of the cushion are secured. The bladder 1 is placed underneath a patient so that the patient's body rests on the padded cushion 101 above the top sheet 5 of the bladder. The bladder 1 is generally aligned with the patient's body so that the patient's lower back is supported by the first and second rear subchambers 27, 29, the patient's legs are supported by the support legs 41 and the patient's tail bone fits in the open space defined by inner end portion 65 of the bladder. The bladder 1 is secured to the patient by placing the hip strap 153 and leg straps 157 over the patient's body, threading the straps through corresponding grommets 155, 161, and securing the fastener strips 165 to the portion of the straps overlying the patient's body. First and second rear subchambers 27, 29 cushion a patient's lower back and allow selective adjustment of the fluid pressure in each subchamber to minimize pressure points concentrated near the injured area of the patient. First and second support legs 41 provide support and cushioning to the patient's legs and can be similarly adjusted to minimize pressure points. The respective chamber valves 37, 51 are readily accessible to the patient through the side openings 137, 139 in the padded cushion 101. Once the bladder 1 is positioned, air can effectively circulate through the channel 59 to facilitate healing of the injured area.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An inflatable bladder for supporting a body of a person for relieving pressure on a portion of the body not engaging the bladder, the bladder comprising:

at least one rear chamber adapted to receive and maintain a first charge of fluid within said rear chamber; and at least one front chamber for supporting the legs of the person, said front chamber comprising two support legs for supporting the legs of said person, said support legs being spaced apart from each other to form a channel between the support legs, said channel being sized and shaped for placement beneath a portion of said body to relieve pressure on said portion, said front chamber being adapted to receive and maintain a second charge of fluid within said front chamber separately from the rear chamber, said front chamber comprising at least two subchambers sized and shaped to hold separate charges of fluid.

2. An inflatable bladder as set forth in claim 1 further comprising at least one front chamber valve in fluid communication with the front chamber and one rear chamber valve in fluid communication with the rear chamber, such that each front and rear chamber may be independently filled and maintained at its own pressure.

3. An inflatable bladder as set forth in claim 1 wherein said rear chamber comprises at least two subchambers, said subchambers each being sized and shaped to hold separate charges of fluid.

4. An inflatable bladder as set forth in claim 3 further comprising two front chamber valves, each front chamber valve in independent fluid communication with a respective front chamber subchamber such that each front chamber subchamber may be filled and maintained at its own pressure.

5. An inflatable bladder as set forth in claim 4 further comprising two rear chamber valves, each rear chamber valve in independent fluid communication with a respective rear chamber subchamber such that each rear chamber subchamber may be filled and maintained at its own pressure.

6. An inflatable bladder as set forth in claim 1 wherein an upper surface of at least one of said support legs includes a furrow extending generally longitudinally of the support leg for receiving a portion of one of said legs of a person and maintaining the relative position of said leg portion and the support leg.

7. An inflatable bladder as set forth in claim 1 wherein said front chamber comprises a lower sheet and an upper sheet in generally opposed relation, said upper and lower sheets further being joined along each of their peripheral edges, such that a space between said sheets defines the front chamber of the bladder.

8. An inflatable bladder as set forth in claim 7 wherein said upper and lower sheets are further joined along a seam located inward from the peripheral edges of the sheets and extending longitudinally of at least one of the support legs, said seam forming a furrow centered upon said seam, said furrow being sized and shaped for receiving a portion of one of said legs of the person and maintaining the relative position of said one leg of the person and the support leg.

9. An inflatable bladder as set forth in claim 1 wherein said bladder includes an inner end portion between the support legs opposite a mouth of said channel, said inner end portion having a larger width than the width of the channel for placement beneath an area of said body to relieve pressure on said area.

10. An inflatable bladder as set forth in claim 9 wherein said inner end portion is sized and shaped to receive the coccyx of said person for relieving pressure on the coccyx.

11. An inflatable bladder as set forth in claim 1 further comprising a padded cushion adapted for attachment to said bladder for placement between said bladder and person to provide further cushioning to the person.

12. An inflatable bladder as set forth in claim 11 wherein said cushion comprises a soft pad joined to a backing material, said pad and backing material being joined at edge portions to define a sleeve for receiving the inflatable bladder.

13. An inflatable bladder as set forth in claim 12 wherein said soft pad is formed from shearling.

14. An inflatable bladder as set forth in claim 12 wherein said backing material is formed from nylon.

15. An inflatable bladder as set forth in claim 12 further comprising at least one strap attachable to the cushion for attaching the cushion to said person.

16. An inflatable bladder as set forth in claim 15 wherein the strap comprises a hip strap attached to the padded cushion for wrapping about the hips of said person to secure the bladder to the person.

17. An inflatable bladder as set forth in claim 16 further comprising at least one leg strap attached to the padded cushion for wrapping about at least one leg of said person to secure the bladder to the person.

18. An inflatable bladder for supporting a body of a person for relieving pressure on a portion of the body not engaging the bladder, the bladder comprising:

at least one rear chamber adapted to receive and maintain a first charge of fluid within said rear chamber; and p1 at least one front chamber for supporting at least one leg of the person, said front chamber comprising two support legs for supporting the at least one leg of said person, said support legs being spaced apart from each other to form a channel between the support legs, said channel being sized and shaped for placement beneath a portion of said body to relieve pressure on said portion, said front chamber being adapted to receive and maintain a second charge of fluid within said front chamber separately from the rear chamber, said rear chamber comprising at least two subchambers sized and shaped to hold separate charges of fluid.

19. An inflatable bladder for supporting a body of a person for relieving pressure on a portion of the body not engaging the bladder, the bladder comprising:

at least one rear chamber adapted to receive and maintain a first charge of fluid within said rear chamber;

at least one front chamber for supporting at least one leg of the person, said front chamber comprising two support legs for supporting the at least one leg of said person, said support legs being spaced apart from each other to form a channel between the support legs, said channel being sized and shaped for placement beneath a portion of said body to relieve pressure on said portion, said front chamber being adapted to receive and maintain a second charge of fluid within said front chamber separately from the rear chamber;

a padded cushion adapted for attachment to said bladder for placement between said bladder and person to provide further cushioning to the person, the cushion comprising a soft pad joined to a backing material, said pad and backing material being joined at edge portions to define a sleeve for receiving the inflatable bladder; and at least one strap attachable to the cushion for attaching the cushion to said person.

20. An inflatable bladder for supporting a body of a person and for relieving pressure on a portion of the body not engaging the bladder, the bladder comprising:

at least one chamber adapted to receive and maintain a charge of fluid within said chamber, said chamber comprising a hip support and two support legs extending from the hip support for supporting leas of the person, said support leas being sized and shaped to form a channel, said channel being sized and shaped for placement beneath a portion of said body to relieve pressure on said portion;

a padded cushion adapted for attachment to said bladder for placement between said bladder and person to provide further cushioning to the person the cushion including a hip section adapted to overlie the his support and leg sections adapted to overlie respective ones of the leg supports; and straps attachable to the cushion for attaching the bladder to said person, the straps including a leg strap associated with one of the leg sections for wrapping about one of the legs of said person and a hip strap associated with the hip section for wrapping about the hips of said person.

21. An inflatable bladder as set forth in claim 20 wherein said cushion comprises a soft pad joined to a backing material, said pad and backing material being joined at edge portions to define a sleeve for receiving the inflatable bladder.

22. An inflatable bladder as set forth in claim 20 wherein said straps comprise two leg strap straps each strap attached to a respective leg section of the padded cushion.

23. A method for elevating and supporting a coccyx of a patient to relieve pressure and reduce pain and irritation, said method comprises the following steps:

placing an inflatable bladder having at least two subchambers therein underneath a patient;

attaching the bladder to the patient by wrapping straps attachable to the bladder around the patient and securing the straps and bladder to the patient;

selectively adjusting the air pressure within the bladder between the subchambers to support the patient without placing undue pressure upon a particular portion of the patient's body.

24. A method as set forth in claim 23 wherein said straps includes hip straps for attachment to the patient's hips and leg straps attachable to the patient's legs.

25. A method as set forth in claim 23 wherein said bladder includes multiple chambers to support the patient and allows adjustment of air pressure within each chamber.

* * * * *